United States Patent [19]

Keck, Jr.

[11] 4,425,000

[45] Jan. 10, 1984

[54] FIRE HOSE DONUT ROLL CARRIER

[76] Inventor: Paul Keck, Jr., 886 NE. 117 St., Biscayne Park, Fla. 33161

[21] Appl. No.: 310,088

[22] Filed: Oct. 9, 1981

[51] Int. Cl.[3] ..... B65D 63/18

[52] U.S. Cl. ..... 294/165; 294/151

[58] Field of Search ..... 294/165, 166, 150, 151, 294/149, 74, 67 E, 67 EA

[56] References Cited

U.S. PATENT DOCUMENTS

| | | | |
|---|---|---|---|
| 2,243,387 | 5/1941 | Livingston | 294/165 |
| 3,792,806 | 2/1974 | Layton | 294/165 |
| 4,061,259 | 12/1977 | Hurst | 294/151 |

*Primary Examiner*—James B. Marbert
*Attorney, Agent, or Firm*—Eugene F. Malin

[57] ABSTRACT

This invention relates to a collapsible fire hose carrier having handles in connection with carrying and storing rolled fire hoses. The collapsible fire hose carrier consists of a base and two side pieces or rigid sheet material. In its uncollapsed state, the carrier holds the rolled fire hose on the base and is fastened between the two sides by means of a quick release mechanism, such as a seat belt device. When the seat belt is released the carrier's sides collapse openly and the hose is in a ready position to be unrolled for use in a fire.

4 Claims, 6 Drawing Figures

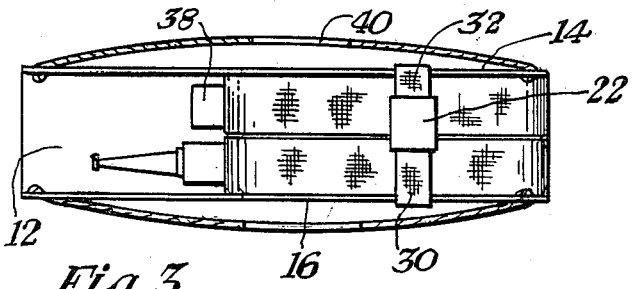
Fig. 3.
Fig. 4.
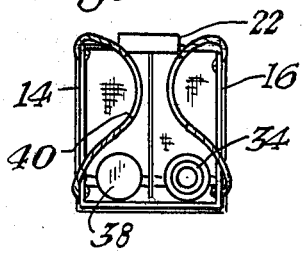
Fig. 6.
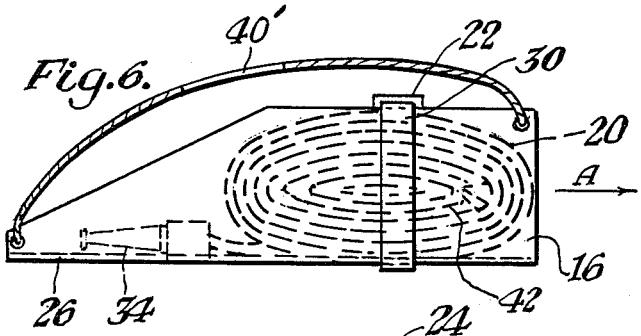
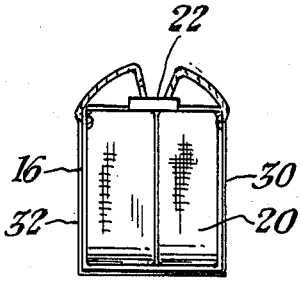
Fig. 5.
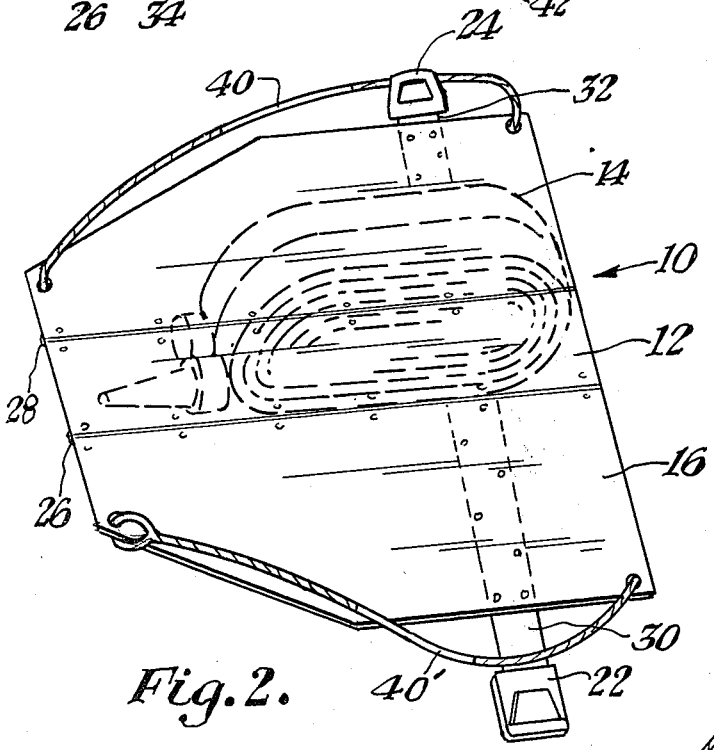
Fig. 2.
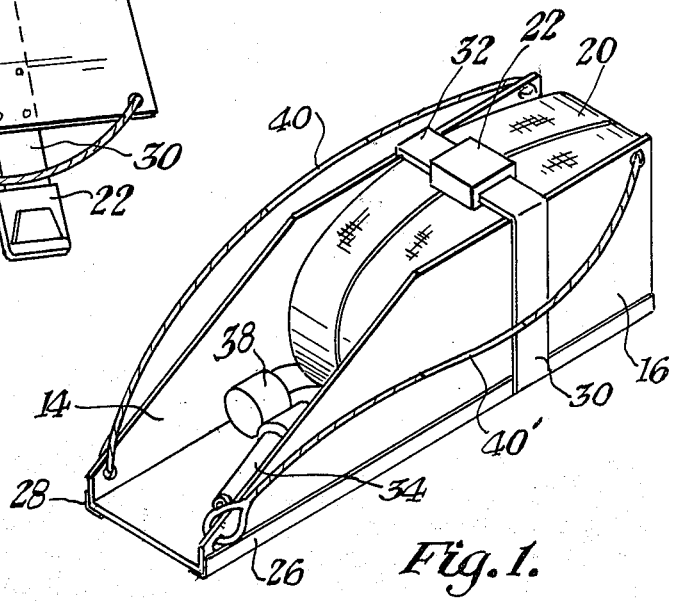
Fig. 1.

FIRE HOSE DONUT ROLL CARRIER

BACKGROUND OF THE INVENTION

In the past rolled fire hoses were carried by a rope handle connected through the center of the circle of the rolled fire hose. The heavy fire nozzle is positioned between 9 and 12 O'clock in order to keep it from dragging in the ground when being carried. When the roll was placed on the floor and the rope released, the hose had to be turned over in order to place the nozzle on the floor before unrolling the rolled up hose. After the fireman turned the roll over he would push the roll, like one rolls a tire, to unroll the entire hose.

BRIEF DESCRIPTION OF THE INVENTION

This invention provides a fire hose carrier with handles that is light weight, with a quick release mechanism that allows the hinged sides to collapse away from the fire hose in to a flat configuration on the floor. This leaves the unrolled hose positioned with the nozzle already lying down on the base that is positioned on the floor, the roll of hose is positioned for immediate use by unrolling it without further manipulation of the length of hose.

The collapsible fire hose carrier consists of two rigid sheet side members joined by their respective hinge means to a common, rectangular base. The base is also a rigid sheet member. The rigid sheets comprising the carrier may be constructed of aluminum, stainless steel, rigid plastic or other suitable material. The hinge means may be a synthetic fabric hinge or a piano type hinge of metal or plastic. The size of the side members and base could be increased proportionately to accommodate single or double lengths of fire hoses of varying footage and width. Fire hoses are sometimes rolled up in a double or side by side fashion. For example, a length of hose will be folded at its halfway point, then rolled with the halfway point becoming the center of the roll. This will cause the male and female coupling to be adjacent when fully rolled. The double rolled hose is placed in the carrier with a nozzle attached and the female coupling lying down on the base to minimize the time needed to place the fire hose in an in use position. The side members are moved into a parallel position sandwiching the roll of hose therein between the side members and then secured by the quick release mechanism. The quick release mechanism may include a male and female coupling means such as a seat belt device. A male portion of the device is secured to one side member and the female portion of the device is secured to the other side member at a properly positioned point to allow the seat belt device to provide proper balance when the fire hose carrier is carried by the handles. The handles may be ropes or cords attached to their respective side members so that they can be held in one hand for carrying when the side members are in their parallel position sandwiching the firehose therebetween. The handles themselves may incorporate a quick release mechanism which will provide the dual functions of handle for carrying and retaining means for holding the side members in a parallel position sandwiching the roll of hose therebetween. In the alternative the handle and retaining means may be functionally distinct.

It is an object of this invention to provide a noncomplex fire hose carrier.

It is another object of this invention to provide a fire hose carrier that can be operated quickly and efficiently to aid firemen in their work.

It is an additional object of this invention to provide a low cost fire hose carrier.

In accordance with these and other objects which will be apparent hereinafter, the instant invention will now be described with particular reference to the accompanying drawings.

BRIEF DESCRIPTION OF THE DRAWINGS

FIG. 1 is an isometric view of the uncollapsed fire hose carrier that includes a base and two side members connected by hinges to the base and with the side members releasonably held in place by a quick release handle.

FIG. 2 is a top view of the collapsed fire hose carrier with the two side portions released by the quick release handle and a rolled fire hose shown in phantom view.

FIG. 3 is a top view of the fire hose carrier with the fire hose in place.

FIG. 4 is an end view of the fire hose carrier showing the fire hose nozzle and coupling.

FIG. 5 is an end view of the fire hose carrier with the fire hose in place.

FIG. 6 is a side view of the fire hose carrier with the fire hose shown in phantom view.

DESCRIPTION OF THE PREFERRED EMBODIMENT

Referring now to the drawings the fire hose carrier 10 is a light weight collapsible fire hose carrier that holds a rolled fire hose for storage and immediate use in an in use position. The collapsible fire hose carrier 10 consists of three pieces 12, 14 and 16 of sheet aluminum, stainless steel or rigid plastic. In its uncollapsed state shown in FIG. 1, the carrier 10 holds the rolled (not shown) or double rolled fire hose 20. The hose 20 is fastened in the carrier 10 by means 22 and 24 of a quick-release handle or a seat belt handle device. When the carrier 10 is placed on a floor on its base 12 and then the quick-release mechanism 22 and 24 is released, the carrier 10 collapses. The sides 14 and 16 of the carrier 10 fall down and the fire hose 20 is in its ready-to-be-used-unrolled position as shown in FIG. 2. The fire hose 20 may be unrolled by rolling the rolled up hose in the direction shown by arrow A. The fire hose carrier 10 is light weight with a carry handle or strap 40. The quick-release mechanism includes a female portion 22 and a male portion 24. The carrier 10 is designed to collapse by allowing the sides to fall away from the sides of the rolled fire hose 20. This leaves the unrolled hose perfectly positioned with the nozzle 34 and coupling 38 on the base that is on the floor for unrolling. Therefore, after the carrier 10 is opened the fire hose is in a ready to use position, the roll needs only to be unrolled without further manipulation.

The rigid sheet collapsible fire carrier 10 includes two side-members 16 and 14 joined to a common, rectangular base 12 by means of hinges 26 and 28 respectively such as a piano-type hinge. The hinges may also be a fabric such as that used on the staps 30 and 32.

The side members and base may be increased proportionately in size to accomodate single or double lengths of hosed ranging in various footages.

The rolled hose 20 is placed in the carrier 10 with the nozzle 38 and coupling 34 lying down flat on the base 12 to minimize the time needed to place the hose in a ready for use position. The side members 14 and 16 secure the sides of the rolled hose by use of the quick-release mechanism 22 and 24. The handle is quickly released and the sides 16 and 14 drop to place the hose in the position shown in FIG. 2.

The carrier 10 is provided with handles 40 and 40' which are connected to side members 14 and 16 respectively. The handles 40 and 40' are flexible ropes or cords which may be held in one hand (not shown) when the side members 14 and 16 are closed on the fire hose 20 as shown in FIGS. 1, 3, 5 and 6.

The hose 20 is rolled up in a side by side fashion as it is doubled in the center 42. This manner of storing the hose allows convenient unrolling of the hose 20 when the carrier 10 is collapsed as it is important for the nozzle to be within reach of the water valve (not shown) which is usually adjacent to where the coupling 38 is attached. This permits one man to gain control of the nozzle 34, connect the coupling 38 to the water source and turn the valve (not shown), all within arms reach.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A fire hose carrier for carrying a rolled hose ready for unrolling for use in a fire comprising:

a base means for supporting said rolled hose ready for unrolling for use in a fire;

two side members each having a proximal portion and a distal portion, said proximal portion of each of said side members movably connected to said base means from a position in the plane of said base means when said hose carrier is opened for using said rolled hose in a fire to a position generally perpendicular to said base means when said hose carrier is closed for carrying said rolled hose; and a means for retaining said two side members in said position generally perpendicular to said base member with said rolled hose positioned therebetween and resting on said base member, said means connected to said hose carrier.

2. A fire hose carrier as set forth in claim 1, wherein:

said means for retaining said two side members includes a quick connect-disconnect device.

3. A fire hose carrier as set forth in claims 1 and 2, wherein:

said means for retaining includes a handle means for carrying said fire hose carrier.

4. A fire hose carrier as set forth in claims 1 and 2, further comprising:

a handle means for carrying said fire hose carrier, said handle means operably connected to said fire hose carrier.

* * * * *